United States Patent [19]

Argo et al.

[11] 4,222,748

[45] Sep. 16, 1980

[54] ELECTROSTATICALLY AUGMENTED FIBER BED AND METHOD OF USING

[75] Inventors: Wesley B. Argo; Burton B. Crocker; Charles C. Sisler, all of St. Louis, Mo.

[73] Assignee: Monsanto Company, St. Louis, Mo.

[21] Appl. No.: 12,911

[22] Filed: Feb. 22, 1979

Related U.S. Application Data

[63] Continuation-in-part of Ser. No. 894,951, Apr. 10, 1978, abandoned.

[51] Int. Cl.[2] ..... B03C 3/12; B03C 3/16

[52] U.S. Cl. ..... 55/6; 55/13; 55/118; 55/131; 55/138; 55/155; 55/242

[58] Field of Search ..... 55/6, 7, 10, 12, 13, 55/118–120, 122, 124, 129, 131, 138, 152, 155, 242

[56] References Cited

U.S. PATENT DOCUMENTS

| | | | |
|---|---|---|---|
| 1,888,606 | 11/1932 | Nesbit | 55/129 |
| 2,662,608 | 12/1953 | Fields | 55/138 |
| 3,874,858 | 4/1975 | Klugman et al. | 55/10 |
| 3,883,328 | 5/1975 | Spain | 55/131 |
| 3,958,958 | 5/1976 | Klugman et al. | 55/10 |
| 3,958,962 | 5/1976 | Hayashi | 55/152 |
| 3,980,455 | 9/1976 | Masuda | 55/152 |
| 4,029,482 | 6/1977 | Postma et al. | 55/131 |
| 4,072,477 | 2/1978 | Hansen et al. | 55/10 |

FOREIGN PATENT DOCUMENTS

| | | | |
|---|---|---|---|
| 2317354 | 10/1974 | Fed. Rep. of Germany | 55/131 |

OTHER PUBLICATIONS

Sabert Oglesby et al., A Manual of Electrostatic Precipitator Technology, Part 1 Fundamental, Southern Research Inst., 8/1970, pp. 21–22.

B. Crocker et al., Air Pollution Control Methods, Reprinted From Kirk-Othmer, Encl. Of Chemical Technology, vol. 1, Third Edition, 1978, pp. 649, 685, 686.

Electric Spark of Ionizers Hikes Scrubber Efficiency, Chemical Engineering, Sep. 26, 1977, pp. 52, 54, 56, 58.

*Primary Examiner*—David L. Lacey

*Attorney, Agent, or Firm*—Lawrence L. Limpus

[57] ABSTRACT

A method and apparatus for removal of particulates from gas streams with high collection efficiency on even submicron particulates. The apparatus includes a grounded fiber bed of 50 to 1000 micron average diameter fibers packed to a bed voidage of at least 90%, an electrostatic or ionizing field means upstream of the fiber bed to place an electrical charge on the particulates, and irrigation means for the fiber bed, and optionally the grounded electrodes of the electrostatic means as well, to flush collected particulates from the fiber bed and optionally from the grounded electrodes. The method is suitable for separation of any particulates but is particularly advantageous for separation of insoluble solid particulates from gas streams at high bed velocities of from 6 to 15 or more feet per second (i.e., 1.8 to 4.6 or more meters per second). The preferred fiber bed is of 100 to 500 micron diameter, and advantageously 100 to 250 micron diameter, glass fibers. In operation, particulates are charged in the electrostatic means and the charged particulates are collected in the fiber bed where the electrical charge is dissipated through the irrigating liquid/particulates mixture so that no significant space charge effect is allowed to develop in the fibers of the fiber bed and re-entrainment of particulates is avoided.

28 Claims, 7 Drawing Figures

ELECTROSTATICALLY AUGMENTED FIBER BED AND METHOD OF USING

This invention is a continuation-in-part of application Ser. No. 894,951, filed Apr. 10, 1978, now abandoned.

BACKGROUND OF THE INVENTION

This invention provides a method and apparatus for removing particulates, including submicron particle size insoluble solid particulates, from a gas stream using a fiber bed collector from which collected insoluble solid particulates can be removed during operation without the need for removing the fiber bed from service for cleaning. The invention permits high collection efficiency, extended continuous operation without any unacceptable increase in pressure drop and service life for the fiber bed separator not limited by the pluggage rate of the fiber bed.

Industrial waste gases and process gas stream frequently contain undesirable solid particulates which must be separated from the gas stream for environmental or process requirements. Particulates having a particle size of 3 or more microns are easily recovered with high efficiency in many types of conventional separators. Smaller particulates, and particularly those of submicron size, and especially those down to about 0.2 micron in size are more difficult to separate with a high degree of efficiency.

Fiber bed separators are commonly used for particulate separation. These fall into three classes: high efficiency as regards submicron particulates, high velocity, and spray catchers.

High efficiency fiber bed separators typically use 5 to 20 micron fibers, such as glass fibers, packed to a bed voidage of from 85 to 98% for separation of submicron particulates with 95 to 98% efficiency, but at low gas flow rates (i.e., bed velocities) typically up to about 0.5 feet per second (or about 0.15 meters per second). At be velocities about this level, significant increases in pressure drop through the fiber bed will result, with consequent increase in power requirements. Liquid particulates such as mists, etc. effectively drain from the fiber bed during operation. Readily soluble solid particulates can be removed from such fiber beds during operation by irrigating the fiber bed with a liquid in which the solid particulates are readily dissolved. Gas streams containing any appreciable loading of insoluble solid particulates, and particularly over 1 micron in size, cannot be treated in high efficiency fiber bed separators, even with irrigation, without gradual build-up of insoluble particulates within the fiber bed until the fiber bed either becomes plugged or the pressure drop through the fiber bed due to plugging has increased to an unacceptable degree, at which point the fiber bed must be taken out of service for cleaning or replacement.

High velocity fiber bed separators are used in applications where high gas flow rates (e.g., bed velocities of from 5 to 10 feed per second; i.e., 1.5 to 3 meters per second) are desired and less efficient separation of submicron particulates can be tolerated. This type of fiber bed separator typically used 25 to 50 micron diameter fibers with a bed voidage of from 85 to 98%. For any given bed voidage, the coarser fibers of a high velocity fiber bed (as compared to a high efficiency fiber bed) has considerably less fiber surface area per unit volume of fiber bed and accordingly a more open network of fibers. Therefore, this type of bed relies more heavily on an inertial impaction mechanism of particulate separation and thus has poorer efficiency for separation of submicron particulates. Removal of insoluble solid particulates from such fiber beds by irrigation or flushing is possible for lower particulate loadings and particulates up to about 2 microns in size, but here again gradual increase in pressure drop and eventual pluggage will result due to difficulty in removing larger sized particulates present in most applications, requiring removal from service for cleaning or replacement after several days to weeks of operation.

Finally, spray catcher fiber beds are used in applications wherein high volumes of gases are to be treated and separation of only large particulates of 3 microns or greater in size is of concern. A spray catcher typically uses fibers of about 100 to 300 microns average diameter with a bed voidage of 90 to 98%. These fiber beds have the lowest fiber surface area per unit volume of any of the types of fiber bed separators discussed herein at any given bed voidage. They rely almost entirely on the inertial impaction separation mechanism. Accordingly, the spray catcher has the poorest efficiency of all for separation of submicron particulates. However, even large (e.g., 5 micron) insoluble solid particulates can be irrigated or flushed out of spray catcher fiber beds.

This invention is directed to the use of the spray catcher type of fiber bed for the separation of particulates, and particularly insoluble solid particulates, from gas streams at high bed velocities of about 5 feet per second (i.e., 1.8 meters per second) or more, with a high efficiency of at least 90% on separation of submicron particulates, and with liquid irrigation of the fiber bed to remove the collected solid particulates therefrom for long term continuous operation, without the need for taking the fiber bed out of service for cleaning or replacement due to pluggage.

As used herein, the term "insoluble solid particulates" refers to solid particulates which will not dissolve in water or such other liquid system as may be selected as the irrigation liquid, or which have such low solubility rates in the liquid that their solubility cannot be effectively used for their removal from the fiber bed.

DESCRIPTION OF THE PRIOR ART

It is known that electrostatic augmentation will improve the collection efficiency of most types of separators for removing particulates from gases. Nevertheless, we know of no electrostatically augmented fiber bed separator which avoids the problem of gradual increase in pressure drop through the fiber bed due to pluggage, which eventually requires that the fiber bed be taken out of service for cleaning or replacement.

U.S. Pat. Nos. 3,874,858 and 3,958,958 to Klugman et al. teach an apparatus and method for removal of particulates from a gas stream using a packed wet scrubber after first placing an electrical charge on the particulates in an electrostatic field. The charged particulates are separated in the packed wet scrubber, which is maintained electrically neutral, by a "force of attraction" mechanism between the charged particulate and the electrically neutral wet packing. Such collection mechanism is taught by the patentees to require that the gas stream be flowed at a velocity sufficiently low for the attraction forces to overcome particle velocity and the viscuous drag force of the gas on the particulates. The patentees set an upper limit of 10 feet per second (about 3 meters per second) bed velocity on their invention, but their test results indicate that at 4 and at 7 feet per second (i.e., about 1.2 and 2.1 meters per second, respectively) their collection efficiency with respect to submicron particulates was substantially below 90%. Moreover, the apparatus itself is very large requiring a great depth of packing in the direction of gas flow, i.e., 24 and 48 inches in their examples.

More recently, U.S. Pat. No. 4,029,482 to Postma et al. teaches removal of particulates by a dry fiber bed, after first placing an electrical charge on the particulates in an electrostatic field, with at least initially a high efficiency for separation of submicron particulates. The charged particles are separated in the dry fiber bed, which is electrically-resistive (i.e., non-conducting), by a "space charge" mechanism whereby the charged particulates which are collected in the dry, non-conductive fiber bed cause an appreciable electrical charge density to develop within the fiber bed, causing gas-borne charged particulates to deviate from the direction of gas flow to increase the collection efficiency of the fiber bed.

Postma et al. distinguish their "space charge" approach from prior art "image forces" mechanisms which appear to be the same as the "force of attraction" mechanism used by Klugman et al. The image forces approach of the prior art is taught by Postma et al. to be limited to low gas flow rates (i.e., bed velocities) and to provide only modest improvement in collection efficiency for submicron particulates. As mentioned above, these are the disadvantages noted above with respect to Klugman et al.

However, while Postma et al. may have overcome these disadvantages, it was at the expense of accepting another major disadvantage; that is, the inability to clean the fiber bed while it is in service to maintain a low pressure drop. The Postma et al. separator operates by build-up of collected particulates in the dry fiber bed to develop the desired space charge. With constant bed velocity, the pressure drop through the fiber bed will increase as the fiber bed becomes increasingly plugged, until at some point the fiber bed must be taken out of service and cleaned. Moreover, it is apparent from Postma et al. that peak collection efficiency of their separator is at bed velocities of only 3 feet per second (about 0.9 meters per second), with a sharp drop off in collection efficiency at higher bed velocities.

Of great significance to the present invention is the teaching in Postma et al. of experiments with fiber beds wet by a water spray and with conductive fiber beds, both of which adversely affected collection efficiency. Postma et al. attribute this loss of efficiency to the fact that such wet fiber beds or conductive fiber beds would operate by the "image forces" mechanism rather than by their "space charge" mechanism.

Thus, the prior art teaches that use of the "image forces" or "force of attraction" collection mechanisms require use of low bed velocities and provide only moderate efficiency with respect to separation of submicron particulates. The prior art further teaches that these disadvantages can be over come by using the "space charge" mechanism, but requires acceptance of a new disadvantage, i.e., the inability to keep the fiber bed cleaned of collected insoluble particulates while in service and acceptance of gradual increase in pressure drop through the fiber bed until the fiber bed finally must be taken out of service and cleaned.

SUMMARY OF THE INVENTION

It is an object of this invention to provide a method and apparatus for removing particulates from a gas using a fiber bed collector with low pressure drop through the fiber bed.

It is another object of this invention to provide a method and apparatus for removing particulates, and particularly insoluble solid particulates, from a gas using a fiber bed collector from which collected insoluble solid particulates can be removed during operation without the need for removing the fiber bed from service for cleaning.

A further object is provision of such a method and apparatus wherein even submicron particulates may be separated from the gas stream with high collection efficiency.

A further object is provision of a method and apparatus wherein a fiber bed may be used for high efficiency separation of insoluble, submicron sized solid particulates, with the insoluble solid particulates collected therein being removed therefrom during operation, without interruption of service, to preclude any unacceptable increase in pressure drop through the fiber bed during extended continuous operation.

A further object is provision of a method and apparatus wherein the continuous service life of a fiber bed separator for insoluble solid particulates is no longer limited by the pluggage rate of the fiber bed.

These, and further objects will be evident from the disclosure set forth herein and from the following discussion of the preferred embodiments, are attained as follows.

The method described herein comprises the steps of passing a particulate containing gas stream through, first, an electrostatic or ionizing field to place a positive or negative charge on said particulates, and subsequently, a bed of fibers as hereinafter characterized, while concurrently irrigating said fiber bed with a liquid at a liquid flow rate such that at least a sufficient portion of the fiber bed contains sufficient liquid so as to continuously dissipate the charge from the fiber bed and the charged particulates collected therein through said liquid to an electrical ground without developing any significant space charge in the fibers and collected particulates on the fiber bed. Any liquid may be used which is either itself conductive or which becomes conductive by virtue of the particulates suspended and/or dissolved therein during operation.

The apparatus described herein is particularly adapted to carrying out the above process and comprises a housing having inlet and outlet ends, a particle charging section within said housing comprising electrostatic or ionizing field means, a bed of fibers as hereinafter characterized disposed between said particle charging section and the outlet, irrigating means for providing a flow of liquid through said fiber bed at a liquid flow rate such that at least a sufficient portion of the fiber bed contains sufficient liquid so as to continuously dissipate the charge from the fiber bed and the charged particulates collected therein through said liquid to an electrical ground without developing any appreciable space charge in the fiber bed.

While this method and apparatus are suited for separation of any liquid or solid particulates from gas streams at high bed velocity with high collection efficiency for even submicron particulates, this method and appparatus will find particular application to the separation of insoluble solid particulates from gases with high efficiency and at high bed velocities of from about 6 to 15 feet per second (i.e., about 1.8 to 4.6 meters per second) or more.

The fiber bed used in this apparatus and method is a bed of fibers of from about 50 to 1000, and particularly from about 100 to 500, microns average diameter, packed to a bed voidage of at least 90%. Preferable fibers of from about 100 to 250 microns in average diameter are used, with a bed voidage of from about 95 to 98%. For example, fibers of 200 microns average diameter packed to a bed voidage of 95% will provide a fiber surface area of about 305 square feet per cubic foot of fiber bed (i.e., about 1013 square meters per cubic meter).

Although the charge is dissipated from the fiber bed so that no appreciable charge is permitted to develop in the fibers of the fiber bed or to remain in the collected particulates, space charge effects are present within the gas phase in the fiber bed particularly at larger fiber diameters and with larger particulates. In the preferred embodiment using 100 to 250 micron average diameter fibers, however, the image forces collection mechanism is maximized and the space charge collection mechanism is minimized. In the less preferred embodiment of 500 to 1000 micron average diameter fibers, conversely, the space charge collection mechanism (in terms of the gaseous phase) is maximized and the image forces mechanism is minimized.

Preferably, the fibers used will have a relatively uniform distribution of fiber diameters within ±30% of the average fiber diameter selected. However, as long as the average fiber diameter is within the broad range set forth in the previous paragraph, a wide range of fiber diameter distribution can be tolerated provided not more than about 10% of the fibers have diameters below 40 microns.

Bed voidage, expressed as volume percent void fraction, is defined by the following equation:

$$V\% = (D_f - D_p)/D_f \times 100$$

where V%=percent void fraction, $D_f$=density of the fiber material, and $D_p$=packing density of the fiber bed. For example, using glass fibers having a specific gravity of, for example, 2.55, the density of the fiber material ($D_f$) will be 159 pounds per cubic foot (2.55 grams per cubic centimeter). A bed of 200 micron average diameter glass fibers packed to a packing density ($D_f$) of 7.0 pounds per cubic foot (0.11 grams per cubic centimeter) will have a bed voidage (V%) of 95.6%.

As is apparent from the above, the fiber beds used in this invention are a rather loosely packed, open network of relatively coarse fibers. At a void fraction of about 96%, the inter-fiber distance is typically about 5 times the fiber diameter. While insoluble solid particulates can readily be flushed out of such a fiber bed, heretofore such fiber beds have not been suitable for use in removing submicron particles from gas streams with any acceptable degree of efficiency. Rather, their use has been limited to applications where either there are not enough submicron particulates present to be of concern, or where a substantial quantity of submicron particulates are present but need not be removed, or are removed by a prior or subsequent device designed to remove submicron particulates.

The present invention is not limited by the fiber material used. In the preferred embodiment, glass fibers, as well as fibers of other dielectric materials are used; the irrigating liquid and/or the particulates contained therein providing sufficient conductivity for dissipating the electrical charge from the collected charged particles so that no interfering space charge can develop on the fibers and collected particulates in the fiber bed. Such dielectric fiber materials include, for example, such plastic fibers as polyesters, polyvinylchloride, polyethylene terephthalate, flurocarbon polymers such as teflon; nylon; polyalkylenes such as polyethylene and polypropylene; mineral wools; asbestos; etc.

If desired, however, conductive fiber materials can also be used since it is suitable to practice of the present invention that the fiber bed itself be conductive without relying solely on the irrigating liquid/particulates system to dissipate the charge. In this embodiment, irrigation of the fiber bed is still necessary in order to continually wet and flush the collected particulates to prevent or minimize the tendency of dry particulates to become re-entrained in the gas stream. Suitable conductive fiber materials include, for example, metals such as stainless steel, titanium, copper, brass, etc. or any wire mesh or proper fiber diameter, as well as carbon or graphite fibers.

Distribution of the fibers within the fiber bed can be random, but for best results the fibers will be at least partially oriented parallel to the vertical plane transverse to the direction of gas flow and less oriented or substantially randomly distributed across the face of such plane. This is graphically portrayed in FIG. V.

This oriented fiber bed can be quantified by saturating a cubic volume of a test fiber bed (as shown in FIG. V) with water while the cube is disposed such that the more oriented plane is vertical and measuring the residual saturation of water held up in the fiber bed after gravity drainage stops, then rotating the test bed such that the surface thereof which normally would be the downstream surface is now down in the base position, and repeating the residual saturation test. The residual saturation of the cubic fiber bed with the more oriented plane disposed vertically should be at least 15% less than the residual saturation with the other plane oriented vertically. Any capillary and surface tension hold-up of water in the bottom of the fiber bed should be corrected for in such residual saturation tests, or alternately, a large enough fiber bed, e.g., 10 inches (or about 25 centimeters) in each dimension, can be used so that such hold-up becomes negligible with respect to the residual saturation.

Generally, a fiber bed depth in the direction of gas flow of from about 2 to 6 inches (or about 5 to 15 centimeters) will be sufficient for efficient separation of even submicron particulates from the gas stream. Deeper fiber beds will provide only marginally improved collection efficiency, but at the expense of proportionately greater pressure drop. If desired, the fiber bed may comprise a series of fiber beds of shallower depth, e.g., 1 to 2 inches (or about 2.5 to 5 centimeters), in fiber-to-fiber contact with each and/or slightly spaced, e.g., by 0.25 to several inches (or about 0.5 to several centimeters) from each other.

This invention is not limited in the nature of the means or method by which the D.C. electrostatic or ionizing field is created which places the electrical charge on the particles. Such means and methods are well known in the art and typically comprise one or more discharge electrodes of one polarity in conjunction with one or more grounded electrodes, the discharge electrodes being connected to a D.C. power source of up to 35,000 volts or more.

It is necessary, however, that the strength of the electrostatic or ionizing field be sufficient to place the desired electrical charge upon the particulates, and for best results such field should extend across the entire cross-sectional area of the housing in the particle charging zone. For example, at a D.C. current of about 6 to 20 millamperes at 25,000 volts will provide a corona power of 150 to 500 watts suitable for treating about 700 to 1000 actual cubic feet per minute (i.e., 19.8 to 28.3 cubic meters per minute) of gas.

Suitable means for irrigating or flushing the fiber bed to remove particulates therefrom are well known in the art and are not limiting of this invention. It is only required that the irrigation means be suited to irrigating at least the upstream portion of the fiber bed to the bed depth where the substantial majority of the particulates are collected. Preferably, however, the entire fiber bed is irrigated.

Thus, the fiber bed may be irrigated with liquid from a liquid supply header disposed above, or within the upper part of, the fiber bed. As is well known in the art, various liquid distribution means can be employed to distribute the liquid over the top surface of a fiber bed, such as, for example, perforated distributor plates, etc. Baffles may also be advantageously positioned at the top of the fiber bed to prevent gas flow from by-passing the fiber bed around such liquid supply header or liquid distribution means.

Alternatively to, or in conjunction with, such an overhead fiber bed irrigating means, the irrigation liquid can be sprayed onto the upstream surface of the fiber bed where viscous drag from the flowing gas will carry the liquid at least partially through the depth of the fiber bed before gravity drainage will carry the liquid out of the bottom of the fiber bed.

Such viscous gas phase drag on the liquid increases with increasing bed velocity of the gas. At higher bed velocities, e.g., above about 11 feet per second (i.e., about 3.3 meters per second), entrainment of the liquid as droplets in the gas leaving the fiber bed can become a problem, but one which can be eliminated or at least substantially reduced by any of a variety of means for either precluding entrainment at high velocities or separating entrained droplets in subsequent entrainment separators.

The rate of liquid flow required in the fiber bed will depend upon the specific application. The minimum flow rate will be that necessary to prevent a space charge from developing in the fiber bed which will be a function of the fiber bed dimensions, the nature of the fibers with respect to conductivity and the conductivity of the liquid particulates combination within the fiber bed. Beyond this, however, the liquid flow rate must be sufficient to flush the solid particulates out of the voidage of the fiber bed, and will be dependant upon the fiber diameter, the bed velocity of the gas being treated, and the loading of solid particulates in the gas stream per unit volume of fiber bed. For example, water flow rates of from about 1 to 10 gallons per minute/1000 CFM cubic foot of gas flow (i.e., about 3.8 to 38 liters per minute/cubic meter) have been found satisfactory for glass fiber beds separating bark fed boiler dust at loadings of from about 200 to 1000 milligrams per cubic meter of gas at bed velocities of from about 6 to 12 feet per second (i.e., about 1.8 to 3.7 meters per second).

In a preferred embodiment of this invention, the grounded electrodes of the electrostatic field means are also irrigated with liquid to flush collected particulates off the grounded electrodes. Suitable irrigating means, methods and liquid flow rates are well known to those skilled in the art of electrostatic precipitators.

The liquid used may be water or any other liquid dictated by or useful in the particular application. For example, if the particulates being collected are a mixture of insoluble solids with resinous, greasy or solid particulates which are soluble in a given solvent or solution, then that solvent or solution is advantageously used so as to dissolve the solubles as well as flush away the insolubles. Similarly, if the gas stream contains objectionable odoriforous substances or gaseous components such as sulfur dioxide, nitrogen oxides, etc. as well as particulates to be removed, the liquid used will advantageously be one which will either react with or absorb the odoriferous substance or gaseous component. Thus, in various embodiments the liquid may be, for example, aqueous solutions of detergents, ammonium hydroxide or other alkalis, sulfuric acid, acidic or basic salts, etc.; non-aqueous liquids such as diethanolamine or aqueous solutions thereof, etc. Other useful liquids and liquid systems will be obvious to those skilled in the art of gas treatment. If conductive fibers are used, non-conductive liquid/particulate systems may be used.

When treating the particulates laden gas, an electrostatic charge, preferably a negative charge, is placed upon the particulates as they pass through the electrostatic field. Negatively charged particulates permit use of electrostatic fields of higher voltage per centimeter of electrode spacing before spark-over will occur. In a preferred embodiment, particularly when treating very dirty gases having a high dust loading, the electrostatic field means is operated with irrigated grounded electrodes to collect a substantial portion of the charged particles on the grounded electrodes. The grounded electrodes will primarily attract and capture the larger particulates which because of their greater mass acquire a higher charge. While some submicron particulates may be captured on the grounded electrode, they are primarily captured in the fiber bed. Collected particulates may be removed from the grounded electrodes by any conventional means such as rapping or air blast, but more preferably by irrigating the grounded electrodes with liquid continuously or at least intermittantly to flush off the particulates collected thereon before they or agglomerates thereof can be blown off by the gas stream and carried to the fiber bed. In this way as much as 50 to 95% of the dust contained in the gas stream can be removed prior to the fiber bed and reduce the dust loading which must be removed by the fiber bed.

The remaining charged particles, or substantially all if the grounded electrodes are not being used as a collector, are carried in the gas stream to the fiber bed and separated from the gas stream therein while irrigating the fiber bed with a liquid to flush away collected solid particulates and dissipate the electrical charge from the charged particles to prevent any significant space charge from developing in the fiber bed.

The bulk of the particulates are collected in the upstream one-third of the depth (in the direction of gas flow) of the fiber bed, with progressively lesser amounts, particularly of larger particles, collected through the remaining depth. The fiber bed irrigation system is preferably designed to distribute the bulk of the liquid in this upstream portion of the fiber bed, with allowance for viscous gas phase drag on the liquid (which is a function of the bed velocity of the gas) which will carry the liquid deeper into the bed before gravity drainage carries the liquid out of the bottom of the fiber bed.

In a preferred embodiment the irrigating system is designed such that after allowing for gas phase drag on the liquid at least 50% of the irrigating liquid used in the fiber bed flows through the upstream one-third of the depth of the fiber bed. This can be accomplished by irrigating from the top of the fiber bed, or by applying a liquid spray uniformly across the upstream face of the fiber bed (particularly at high bed velocities), or by a combination of both. With this expedient, irrigating liquid requirements can be minimized. Another expedient to further minimize irrigating liquid requirements is to use fiber beds which are high and narrow insofar as the aerodynamics of fiber bed design will permit.

Depending upon the application, it may or may not be desirable to recirculate used liquid back to the fiber bed irrigating means, the optional grounded electrode irrigation means, or both. Conservation and cost, particularly of expensive liquids, make recirculation desirable when feasible. In the simplest situation, it will merely be necessary to separate undissolved solid particulates, by any conventional means, from the liquid prior to recirculation. However, in many applications, the used liquid may contain soluble particulates or absorbed gases or reaction products which will preclude recirculation without at least some prior treatment of the used liquid to regenerate it and remove objectionable constituents.

For example, if the apparatus and method of this invention is used to scrub objectionable gases together with particulates from a waste gas stream, at least partial regeneration of the liquid will be necessary before recirculating the liquid back to the irrigation system. An example would be any of the scrubbing processes for removal of sulfur dioxide from gas streams, such as sodium or ammonia scrubbing, or an alkanolamine scrubbing as taught in U.S. Pat. No. 3,873,673.

It will therefore be apparent that in addition to the above uses the apparatus and method of this invention can be used in a wide variety of industrial and environmental applications for removal of liquid or solid (soluble or insoluble) particulates, or mixtures thereof. In a preferred embodiment, however, the present invention is more particularly directed to applications requiring separation of insoluble solid particulates from gases, and especially where separation of submicron size, insoluble particulates with high efficiency is required. Examples of such insoluble particulates to which the present invention is suited include fly ash, bark bed boiler dust, incineration dusts and fumes, carbon, silica dust, pigment dusts, metalurgical fumes, and the like.

The present apparatus and method are particularly suited to treatment of gas streams at high bed velocities through the fiber bed. Overall collection efficiencies of 98 to 99.9%, with at least 85%, and preferably 90 to 95%, efficiency for submicron particulates in the 0.2 to 0.9 micron range are attainable at bed velocities of 6 to 11 feet per second (i.e., about 1.8 to 3.3 meters per second), or even 15 feet per second (i.e., about 4.6 meters per second) or more with provision for re-entrainment prevention or removal. Despite such high bed velocities, the present invention provides high collection efficiency with minimal pressure drop, in a more compact apparatus than, for example, the packed bed scrubber of Klugman et al. Balancing reduced blower horse power requirements against the power required for the electrostatic field means offers energy savings versus other high efficiency separators such as fiber bed separators, making use of the present invention advantageous in applications where insoluble solid particulates are not present, e.g., ammonium nitrate and urea prill towers, char-broiler fumes, etc.

DESCRIPTION OF THE DRAWINGS

FIG. I is a side cross-sectional view of one embodiment of this invention.

FIG. IA is a top cross-sectional view of the electrostatic field means of FIG. I.

Figure 1:
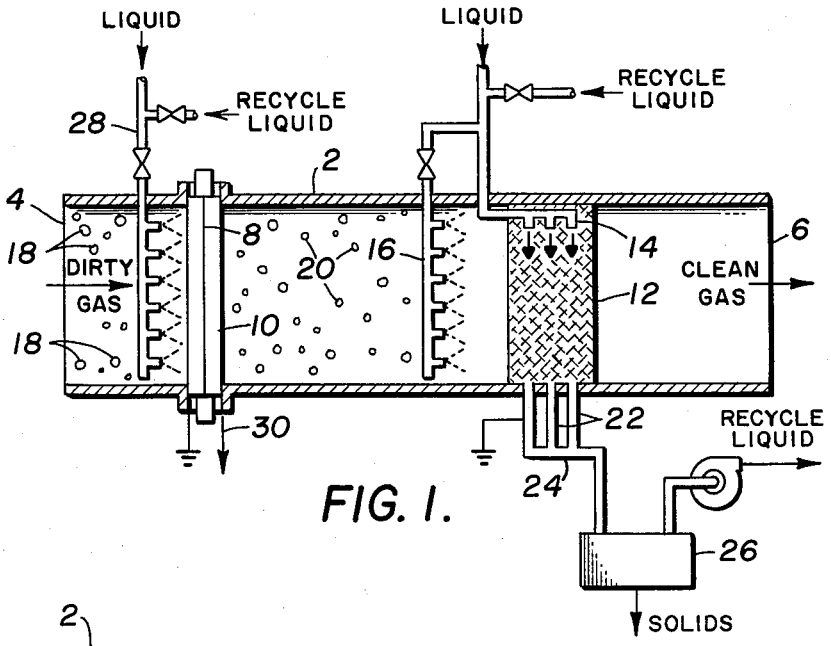
Figure 1A:
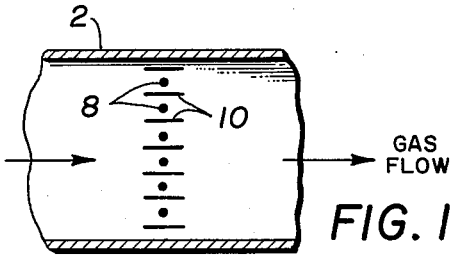
Figure 2:
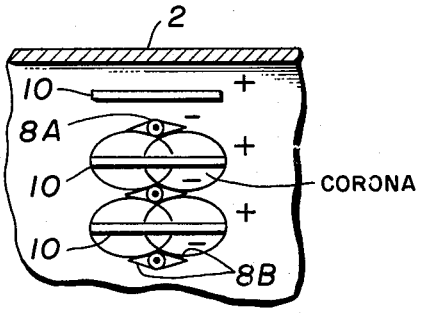
Figure 2A:
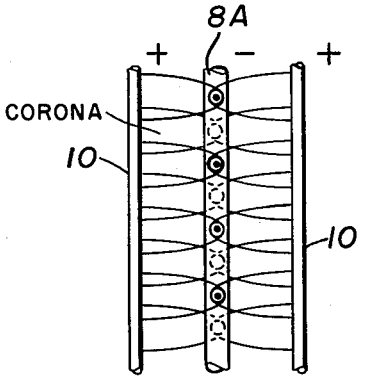
Figure 3:
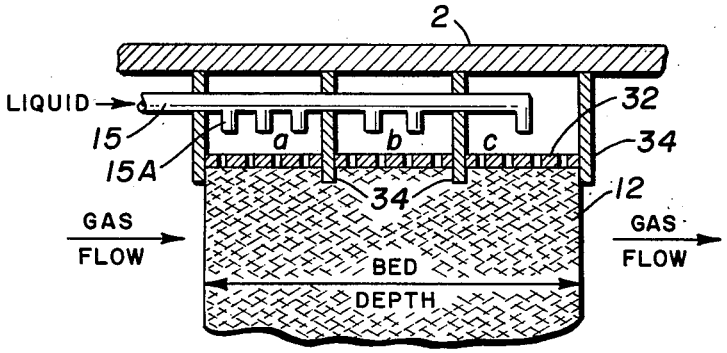
Figure 4:
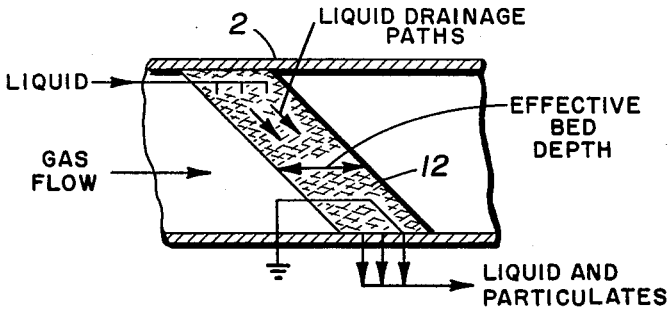
Figure 5:
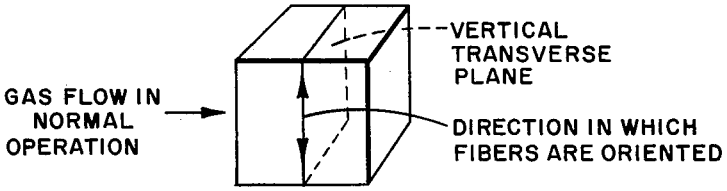

FIGS. II and IIA are top and end views, respectively, of just one segment of a preferred electrostatic field means useful in the practice of this invention.

FIG. III is a side cross-sectional view of the upper portion of a fiber bed with a preferred embodiment of overhead irrigating liquid distribution.

FIG. IV is a side cross-sectional view of an inclined fiber bed, which comprises one embodiment of this invention.

FIG. V is graphic portrayal of the plane of orientation of the fibers in a preferred fiber bed embodiment of this invention.

DESCRIPTION OF THE PREFERRED EMBODIMENTS

In the embodiment represented by FIGS. I and IA, the apparatus of this invention comprises a housing 2 with gas inlet end 4 and outlet end 6. Disposed within said housing proximate said inlet end is an electrostatic field means comprising a plurality of high voltage discharge electrodes 8 connected to a high voltage D.C. source (not shown) and a plurality of grounded electrodes 10. The discharge electrodes 8 may be of either positive or negative polarity, but preferably negative as shown in FIGS. II and IIA. The grounded electrodes 10 will have the opposite polarity with respect to the discharge electrodes, e.g., positive as shown in FIGS. II and IIA.

Disposed within the housing downstream (in the direction of gas flow) of the electrostatic field means is fiber bed 12 with overhead irrigating means 14 for distributing irrigating liquid within the fiber bed. Except for provision for flow of the irrigating liquid, the periphery (edges) of the fiber bed should be appropriately sealed in the housing by a frame (not shown) with gasketing or other conventional edge sealing means to prevent leakage of the gas around the edges of the fiber bed. Spray means 16 is also shown for spraying irrigating liquid uniformly across at least the upper portion of the upstream face of the fiber bed. Under most circumstances overhead irrigation means 14 will provide sufficient irrigation of the fiber bed, making the additional use of spray means 16 unnecessary. However, in appropriate circumstances use of both overhead irrigating means 14 and spray means 16 may be advantageous. In other applications, particularly with light dust loading in the gas or with fiber beds only 2 to 3 inches (5 to 7.6 centimeters) deep in the direction of gas flow or with high enough bed velocity gas flow, spray means 16 may provide sufficient liquid penetration of the fiber bed to make unnecessary the use of overhead irrigating means 14.

In operation, dirty gas containing particulates 18 enters inlet end 4 and passes through the electrostatic field between discharge electrodes 8 and grounded electrodes 10 wherein the particulates become charged, e.g., negatively as shown in the drawings. Charged particles 20 flow downstream to be collected in fiber bed 12 which is connected to an electrical ground. Particlates collected in the fiber bed are flushed therefrom by irrigating with a liquid from either or both of overhead irrigating means 14 and spray means 16. The liquid and particulates contained therein are drained from the bottom of fiber bed 12 and removed from the apparatus.

In an optional embodiment of this invention the used liquid may be treated to remove solid particulates and any other contaminants present and then recirculated back to the irrigation system. In the simplified flow scheme shown in FIG. I, the used liquid drains from the fiber bed into a series of conduits 22, or into a trough (not shown) which in turn drains into conduits 22, into a manifold 24 and thence to a liquid treatment means 26. This liquid treatment means may be simply a single or multiple stage clarifier or settling tank or other system for separating solid particulates from the liquid. Alternatively, liquid treatment means 26 may be any liquid treatment or regenerating system and process for at least partially restoring the used liquid to its original condition for recirculation to the irrigation system. From liquid treatment means 26, all or part of the liquid may be recirculated back to overhead irrigating means 14, or to spray means 16, or both, together with any fresh make-up liquid which may be necessary.

In a preferred embodiment, also shown in FIG. I, the grounded electrodes 10 may be used as collectors for a portion of the charged particulates in which event the grounded electrodes are also irrigated with liquid to flush collected particulates therefrom. Any conventional means and method may be used for such irrigation, for example spray means 28 disposed upstream of grounded electrodes 10. Such spray means 28 may, for example comprise a plurality of tubes off of a manifold (not shown), each tube having a plurality of nozzles and being disposed substantially upstream of a discharge electrode 8, with the nozzles oriented such as to spray liquid on the surfaces of the grounded electrodes facing that discharge electrode.

Liquid and particulates draining down the grounded electrodes is carried away from the bottom thereof by conventional means, not shown but graphically represented by line 30. If recirculation of this used liquid is desired, it may be treated separately, particularly if this liquid is not the same as the liquid used in the fiber bed. If both liquids are the same, however, the used liquid from the grounded electrodes may also be treated in liquid treatment means 26. In various embodiments, only fresh liquid may be used for irrigating the grounded electrodes with recirculation only to the fiber bed irrigation system, or treated liquid can be used for irrigating the grounded electrodes.

In the preferred embodiment shown in FIGS. II and IIA, the electrostatic field means uses as discharge electrodes a plurality of rods 8A, each rod having a plurality of needles 8B projecting therefrom parallel to the direction of gas flow in both the upstream and the downstream directions. As best can be seen in end view FIG. IIA, the spacing between needles 8B projecting upstream from rod 8A (solid circles with dot in center) is substantially equidistant. Similarly the spacing between needles 8B projecting downstream from rod 8A (dotted circles) is also substantially equidistant, but the downstream series of needles is staggered from the upstream needles about half way therebetween. In this way the corona between each needle tip and the grounded electrode as represented by the light parabolic lines in each of FIGS. II and IIA overlap to insure that all particulates will be subjected to the electrostatic field.

In another preferred embodiment where grounded electrodes 10 are used as particulate collectors they are flat or slightly convex plates at least 12 centimeters (or about 5 inches) wide in the direction of gas flow, e.g., from 12 to 25 centimeters (or about 5 to 10 inches) wide. These wide grounded electrodes provide increased residence time of particulates in the electrostatic field which aids in their capture on the grounded electrodes.

Though these drawings show only one bank of discharge electrodes and grounded electrodes in the electrostatic field section of this apparatus, it will be obvious to those skilled in the art that two or more such banks can be provided in series in the direction of gas flow depending upon the needs of a given application.

FIG. III represents in one drawing both one embodiment of overhead irrigating means 14 and one way to distribute a high proporation of the irrigating liquid into the upstream portion of the fiber bed. Liquid manifold 15 is provided with a plurality of liquid discharge tubes or outlets 15A. By appropriate positioning of tubes or outlets 15A along the length of manifold 15 the liquid can be distributed in varying quantities, as desired, along the depth of the fiber bed. The liquid discharges from tubes or outlets 15A over a perforated plate 32 and then flows through the perforations therein into fiber bed 12. A series of baffles 34 are also advantageously provided to confine the liquid into a series of compartments, here shown as 3 compartments a, b and c, as well as to prevent gas from by-passing the fiber bed. As shown, three tubes or outlets 15A project into compartment a, two into compartment b, and one into compartment c. Allowing for pressure drop along manifold 15, this arrangement will discharge at least 50% of the liquid into compartment a which serves about the upstream ⅓ of the depth of the fiber bed. After allowing for viscous gas phase drag on the liquid in the fiber bed, compartment c may be operated dry, i.e., no liquid flow therein, particularly at high gas bed velocities.

FIG. IV represents another embodiment in which fiber bed 12 is included at an angle such that irrigating liquid draining down through the fiber bed under the forces of both gravity and viscous gas phase drag will flow downward through the fiber bed as shown by the arrows substantially along the planes parallel to each face of the fiber bed. This counteracts the effect of viscous gas phase drag which otherwise would carry individual portions of the liquid deeper into the fiber bed and at very high bed velocities off the downstream surface of the fiber bed as re-entrainment. The proper angle of inclination of the fiber bed can readily be calculated by one skilled in the art using vector analysis of the gas phase drag force and gravity force on the liquid at design gas bed velocity and liquid flow rate. This embodiment allows use of shallower fiber beds in terms of depth in the direction of gas flow, and/or higher bed velocities, e.g. 12 to 15 feet per second (3.5 to 4.6 meters per second) or more, with less re-entrainment of liquid from the downstream surface of the fiber bed.

WORKING EXAMPLES

The following table is illustrative of this invention using apparatus as described in FIG. I/IA and II/IIA.

In each test run the fiber bed is a vertical 2 or 4 inch (i.e., 5 or 10.0 centimeters) deep bed of jackstraw type chemically resistant glass fibers of about 200 microns average fiber diameter with a packing density of about 7 pounds per cubic foot (0.11 grams per cubic centimeter) which calculates to provide a bed voidage of about 95.6%. In each instance, the height and width of the fiber bed are each a nominal 12 inches (i.e., 30.5 centimeters). The fibers are partially oriented within the fiber bed such that residual saturation in such vertical position is about 0.4 grams of water per gram of fiber and its residual saturation, when rotated 90° such that its downstream surface (in the direction of gas flow) is in the bottom position is about 1.55 grams of water per gram of fiber.

A series of test runs are reported using fly ash at various loadings in air. In each test runs 1 through 6 only the fiber bed is used as a collector, with water as the irrigating liquid from a distributor above the fiber bed, and no irrigation of the grounded electrode. For comparative purposes, some of these test runs are reported with the electrostatic field turned off as indicated by "None" in the carona power column.

In test run 17 both the fiber bed and the grounded electrodes are used as collectors, with water irrigation of both.

The 10.1 centimeter (i.e., 4 inch) deep fiber bed of runs 11 and 12 (which is a more commercially useful depth to use) gives over 96% average collection efficiency on submicron particulates, even though only 2 stages of wire to plate electrostatic field means are used in series.

Test run 17 illustrates the use of a single stage of the needle to plate electrostatic field means of FIGS. II and IIA with water irrigation of the grounded electrodes (i.e., plates). The results shown are lower than desired but are consistent with the objects of this invention in view of the fact that the desired corona power for the needle to plate electrostatic means used is about 500 to 600 watts while in this test run only 118 watts of corona power was obtained. Collection efficiencies of at least 95% on submicron particulates and higher for larger particulates are extrapolatable from this data at 500 to 600 watts corona power.

The foregoing description of the several embodiments of this invention is not intended as limiting of the invention. As will be apparent to those skilled in the art, the inventive concept set forth herein can find many applications in the art of separation of particulates from gases and many variations on and modifications to the embodiments described above may be made without departing from the spirit and scope of this invention.

| Run No. | Bed Velocity (Meters/Sec.) | Fiber Bed Depth CM | Dust Loading (MG/M³) | $H_2O$/Air Ratio Liters/1000 ACM | Corona Power (watts) | Mean Mass Particle Diameter (Microns) Inlet | Exit | Overall Collection Efficiency | Collection Efficiency By Size (Microns) 0.2 | 0.4 | 0.6 | 0.8 | 1.0 | 2.0 | 1.0 |
|---|---|---|---|---|---|---|---|---|---|---|---|---|---|---|---|
| 1 | 3.0 | 5 | 76.3 | 12.9 | NONE | 1.55 | 0.75 | 77.0% | — | 29.2% | 37.2% | 40.3% | 71.0% | 90.8% | 96.3% |
| 2 | 3.0 | 5 | 105.1 | 12.9 | NONE | 1.45 | 0.64 | 32.0 | — | 42.0 | 63.5 | 64.0 | 73.9 | 93.0 | 98.0 |
| 3 | 3.0 | 5 | 111.4 | 12.7 | 126 | 1.50 | 0.92 | 89.3 | — | 76.2 | 90.1 | 86.6 | 86.4 | 93.7 | 95.8 |
| 4 | 3.0 | 5 | 111.4 | 12.7 | 126 | 1.50 | 0.71 | 91.9 | — | 79.5 | 85.0 | 67.9 | 89.2 | 96.5 | 98.4 |
| 5 | 3.3 | 5 | 178.1 | 23.4 | NONE | 1.75 | 0.56 | 91.4 | — | 72.4 | 74.3 | 82.9 | 90.4 | 97.9 | 99.4 |
| 6 | 3.3 | 5 | 178.1 | 23.4 | 126 | 1.75 | 0.45 | 95.3 | — | 89.7 | 90.7 | 94.9 | 90.5 | 98.6 | 99.3 |
| 7 | 2.5 | 5 | 207.1 | 30.4 | NONE | 1.74 | 0.60 | 90.4 | — | 66.4 | 71.2 | 90.0 | 87.5 | 96.9 | 99.2 |
| 8 | 2.5 | 5 | 207.1 | 30.4 | 126 | 1.74 | 0.56 | 96.6 | — | 88.1 | 91.5 | 96.4 | 96.1 | 98.9 | 99.6 |
| 9 | 3.3 | 5 | 163.2 | 11.7 | NONE | 1.75 | 0.55 | 92.6 | — | 70.2 | 77.7 | 90.7 | 90.6 | 98.3 | 99.4 |
| 10 | 3.3 | 5 | 163.2 | 11.7 | 126 | 1.75 | 0.48 | 96.4 | — | 85.6 | 91.0 | 96.4 | 95.5 | 99.4 | 96.8 |
| 11 | 1.8 | 10.1 | 294.9 | 21.7 | NONE | 1.60 | 0.56 | 92.7 | 63.4 | 73.1 | 85.3 | 86.1 | 90.8 | 96.3 | 99.3 |
| 12 | 1.8 | 10.1 | 294.9 | 21.7 | 126 | 1.60 | 0.47 | 98.4 | 89.7 | 94.5 | 96.9 | 97.5 | 90.4 | 99.7 | 99.9 |
| 13 | 3.3 | 5 | 844.1 | 23.4 | 143 | 3.2 | 0.43 | 99.2 | — | 93.9 | 97.0 | 96.3 | 99.4 | 99.9 | 99.9 |
| 14 | 3.3 | 5 | 837.1 | 23.4 | 120 | 3.0 | 0.45 | 90.9 | — | 90.6 | 97.7 | 97.9 | 98.4 | 99.8 | 99.9 |
| 15 | 1.8 | 5 | 1028.7 | 43.4 | 105 | 2.35 | 0.56 | 99.0 | — | 96.5 | 97.9 | 97.2 | 96.4 | 99.9 | 99.9 |
| 16 | 1.8 | 5 | 753.0 | 43.4 | 122 | 2.50 | 0.55 | 99.2 | — | 95.1 | 90.4 | 98.7 | 90.7 | 99.7 | 99.9 |
| 17 | 3.0 | 10.1 | 926.4 | Fiber bed 3.2 Electrode 1.9 | 119 | 2.00 | 1.15 | 90.2 | — | 85.3 | 86.9 | 90.2 | 90.2 | 92.6 | 94.0 |

In reviewing the data presented in the table, it should be noted that the fiber bed used in test runs 1 through 10 and 13 through 16 is only 5 centimeters (i.e., 2 inches) deep in the direction of gas flow and yet even such a shallow fiber bed provides significant improvement in collection efficiency, particularly of submicron particulates with the practice of this invention.

Test runs 1 thrugh 12 use two stages of wire to plate electrostatic field means (as shown in FIGS. I and IA) in series. Runs 13 through 16 use three stages of such wire to plate electrostatic field means in series, providing longer residence time of particulates in the electrostatic field, to give over 95% average collection efficiency on submicron particulates, even at the high dust loadings shown.

What is claimed is:

1. In a process for continuously removing particulates from a gas stream by flowing the gas sequentially through, first an electrostatic field to place a positive or negative charge on said particulates, and subsequently an irrigated packed bed collector wherein said charged particulates are collected, the improvement whereby even submicron particulates may be separated from the gas stream at high efficiency at high bed velocities while concurrently removing the collected solid particulates from the packed bed without interrupting the gas flow therethrough, which improvement comprises:

(a) flowing said gas stream containing said charged particulates through a bed of fibers having an average fiber diameter of from 50 to 1000 microns, said fiber bed having a voidage of from 90 to 98%, while concurrently (b) irrigating said fiber bed with a liquid (i) at a liquid flow rate such that at least a sufficient portion of the fiber bed contains sufficient liquid to dissipate the electrical charge from the fiber bed and the collected particulates contained therein, and (ii) at least at a frequency such that no significant space charge is permitted to develop within the fibers and collected particulates in the fiber bed, and the collected solid particulates are removed from the fiber bed without substantial retention, (c) dissipating said electrical charge to an electrical ground, and (d) draining said liquid and the particulates contained therein from said fiber bed.

2. A process as in claim 1 wherein said irrigation is continuous.

3. A process as in claim 2 wherein after draining the liquid and solid particulates contained therein from the fiber bed, the solid particulates are at least partially separated from the liquid and the liquid is recirculated for irrigating the fiber bed.

4. A process as in claim 1 wherein the irrigating liquid is distributed within the fiber bed such that at least 50% of the liquid is initially distributed, after allowing for vicous drag thereon of the gas phase, within the upstream one-third of the depth of the fiber bed in the direction of gas flow.

5. A process as in claim 4 wherein said irrigation is continuous.

6. A process as in claim 5 wherein after draining the liquid and solid particulates contained therein from the fiber bed, the solid particulates are at least partially separated from the liquid and the liquid is recirculated for irrigating the fiber bed.

7. A process as in claim 1 further including providing a plurality of grounded electrodes in said first electrostatic field, and said grounded electrodes are at least intermittently cleaned to remove captured particulates therefrom.

8. A process as in claim 7 wherein said grounded electrodes are cleaned by irritating with a liquid.

9. A process as in claim 8 wherein said irrigation of the grounded electrodes is continuous.

10. A process as in claim 9 wherein said irrigation of the fiber bed is continuous.

11. A process as in claim 10 wherein the same liquid is used to irrigate both the fiber bed and the grounded electrodes, suspended particulates are at least partially separated from the liquid drained therefrom, and the liquid is recirculated for irrigating at least one of (a) the fiber bed and (b) the grounded electrodes.

12. A process as in claim 1 wherein the fibers of said fiber bed are at least partially oriented parallel to the vertical plane transverse to the direction of gas flow and less oriented across the face of such plane.

13. In an apparatus for continuously removing solid particulates from a gas stream comprising a housing having inlet and outlet ends, particulate charging section within said housing proximate said inlet and comprising a plurality of high voltage discharge electrodes connected to a D.C. voltage source at least one grounded electrode positioned and arranged with respect to said high voltage electrodes to create a substantially uniform electrostatic field therebetween, a packed bed collector for charged particulates disposed within said housing downstream of said particle charging section, and a means for irrigating said packed bed with a liquid, the improvement whereby even submicron particulates may be separated from the gas stream at high efficiency at high bed velocities while concurrently removing the collected solid particulates from the bed without interrupting the gas flow therethrough, which improvement comprises (a) said packed bed comprising fibers having an average fiber diameter of from 50 to 1000 microns, said fiber bed having a voidage of from 90 to 98%;

(b) said irrigating means comprising means for a liquid flow such that at least a sufficient portion of the fiber bed contains sufficient liquid to dissipate the electrical charge from the fiber bed without permitting any significant space charge to develop within the fiber bed, and the collected solid particulates are removed from the fiber bed without substantial retention.

14. An apparatus as in claim 13 further comprising conduit means for carrying liquid and solid particulates contained therein from the bottom of said fiber bed to a liquid treating means for at least partially separating said liquid from said solid particulates, and conduit means for returning at least a portion of the treated liquid to said fiber bed irrigating means.

15. An apparatus as in claim 13 wherein said fiber bed irrigation means is such as to distribute at least 50% of the liquid within the upstream one-third of the depth of the fiber bed, in the direction of gas flow from said inlet to said outlet end.

16. An apparatus an in claim 15 further comprising conduit means for carrying liquid and solid particulates contained therein from the bottom of said fiber bed to a liquid treating for at least partially separating said liquid from said solid particulates, and conduit means for returning at least a portion of the treated liquid to said fiber bed irrigating means.

17. An apparatus as in claim 13 further comprising means for at least intermittantly cleaning collected particulates from said at least one grounded electrode.

18. An apparatus as in claim 17 wherein said means for cleaning collected particulates from said at least one grounded electrode comprises an irrigating means.

19. An apparatus as in claim 18 further comprising conduit means for carrying liquid and solid particulates contained therein from the bottom of said fiber bed and the bottom of said electrostatic field means to a liquid treating means wherein said liquid is at least partially separated from said solid particulates, and conduit means for returning at least a portion of the treated liquid to at least said fiber bed irrigating means.

20. An apparatus as in claim 19 further comprising conduit means for returning a portion of the treated liquid to said grounded electrode irrigating means.

21. An apparatus as in claim 13 wherein each of said high voltage electrodes comprises a plurality of needles projecting from the front and back of a supporting rod when viewed parallel to the direction of gas flow, said needles being spaced substantially equidistant with respect to each other along the length of said rod, with th needles on the back of said bed being staggered with respect to the needles on the front of said rod substantially one half the distance therebetween.

22. An apparatus as in claim 21 wherein said at least one grounded electrode comprises a plurality of grounded plates at least 12 centimeters wide in the direction of gas flow from said inlet to said outlet end.

23. An apparatus as in claim 22 further comprising conduit means for carrying liquid and solid particulates contained therein from the bottom of said fiber bed to a liquid treating means to separate said liquid from said solid particulates, and conduit means for returning at least a portion of the treated liquid to said fiber bed irrigating means.

24. An apparatus as in claim 21 wherein said fiber bed irrigation means is constructed and arranged such as to distribute at least 50% of the liquid within the upstream one-third of the depth of the fiber bed, in the direction of gas flow from said inlet and to said outlet end.

25. An apparatus as in claim 24 further comprising conduit means for carrying liquid the solid particulates contained therein from the bottom of said fiber bed to a liquid treating means for at least partially separating said liquid from said solid particulates, and conduit means for returning at least a portion of the treated liquid to said fiber bed irrigating means.

26. An apparatus as in claim 21 further comprising irrigating means for at least intermittantly flushing collected solid particulates with a liquid from said at least one grounded electrode in the electrostatic field means.

27. An apparatus as in claim 26 further comprising conduit means for carrying liquid and solid particulates contained therein from the bottom of said fiber bed and the bottom of said electrostatic field means to a liquid treating means for at least partially separating said liquid from said solid particulates, and conduit means for returning at least a portion of the treated liquid to at least said fiber bed irrigating means.

28. An apparatus as in claim 27 further comprising conduit means for returning a portion of the treated liquid to said grounded electrode irrigating means.

* * * * *

UNITED STATES PATENT AND TRADEMARK OFFICE

CERTIFICATE OF CORRECTION

PATENT NO. : 4,222,748

DATED : September 16, 1980

INVENTOR(S) : WESLEY B. ARGO, BURTON B.CROCKER, CHARLES C. SISLER

It is certified that error appears in the above-identified patent and that said Letters Patent are hereby corrected as shown below:

In Column 1, line 39, "be" should read --bed--.

In column 9, line 53, "bed" should read --fed--.

In column 12, line 46, "included" should read --inclined--.

In column 12, line 62, "3.5" should read --3.6--.

In column 13, line 2, "10.0" should read --10.1--.

In column 13, line 17, "6" should read --16--.

In column 16, line 61, "th" should read --the--.

In column 16, line 62, "bed" should read --rod--.

In column 17, line 15, "the" should read --and--.

Signed and Sealed this

*Sixteenth* Day of *December 1980*

[SEAL]

*Attest:*

SIDNEY A. DIAMOND

*Attesting Officer*

*Commissioner of Patents and Trademarks*